United States Patent [19]

Drucker et al.

[11] Patent Number: 4,577,828

[45] Date of Patent: Mar. 25, 1986

[54] FAN COIL BASE PAD ASSEMBLY

[75] Inventors: Alan S. Drucker, Dewitt; King H. Kwok, Liverpool, both of N.Y.

[73] Assignee: Carrier Corporation, Syracuse, N.Y.

[21] Appl. No.: 618,656

[22] Filed: Jun. 8, 1984

[51] Int. Cl.[4] ..... F16M 5/00

[52] U.S. Cl. ..... 248/678; 248/310; 248/346

[58] Field of Search ..... 248/678, 346, 676, 679, 248/D10, 310, 346.1

[56] References Cited

U.S. PATENT DOCUMENTS

| | | | |
|---|---|---|---|
| 2,461,968 | 2/1949 | Derham | 248/346 |
| 2,722,719 | 11/1955 | Alstadter | 248/346.1 |
| 3,096,781 | 7/1963 | Roidt | 248/678 |
| 3,257,092 | 6/1966 | Blundell | 248/346.1 |
| 3,268,198 | 8/1966 | Swett | 248/346.1 |
| 3,276,094 | 10/1966 | Shannon | 248/346 |
| 3,394,832 | 7/1968 | McAllister | 248/310 |
| 3,788,581 | 1/1974 | Rutzick | 248/678 |
| 3,790,115 | 2/1974 | Fox | 248/678 |
| 3,841,032 | 10/1974 | Grannis | 248/678 |
| 4,243,197 | 1/1981 | Wright | 248/678 |

OTHER PUBLICATIONS

IBM Technical Disclosure Bulletin, vol. 19, No. 11, Apr. 1977, D. A. Perry and A. R. Voss-Caster-Machine Shipments.

*Primary Examiner*—Reinaldo P. Machado
*Assistant Examiner*—Alvin Chin-Shue
*Attorney, Agent, or Firm*—Dana F. Bigelow

[57] ABSTRACT

A support base for a polygon shaped cabinet of an indoor fan coil unit. The base is molded of high density non-metallic material, and holds the cabinet during assembly, shipment, and installation of the unit. The base has an indentation in its top, which is the same shape as the polygon cabinet, for supporting the cabinet therein.

4 Claims, 2 Drawing Figures

FAN COIL BASE PAD ASSEMBLY

BACKGROUND OF THE INVENTION

The present invention relates generally to support means for fan coils, and, more particularly, to an improved polystyrene base pad assembly for supporting an indoor fan coil while assembling, shipping, and installing the fan coil unit.

A typical split air conditioning system, which might be a heat pump, includes an outdoor heat exchange unit having an outdoor heat exchanger, compressor, controls and a reversing valve, and an indoor unit. The indoor unit includes an indoor heat exchanger and a fan for circulating indoor air to be conditioned in heat exchange relation with the indoor heat exchanger. Typically, in a cooling mode of operation, the liquid refrigerant is evaporated in the indoor heat exchanger, absorbing its heat of vaporization from the air to be cooled, while in the heating mode of operation, the gaseous refrigerant is condensed to heat the indoor air by discharging its heat of condensation to the air being circulated in heat exchange relation with the heat exchanger.

The indoor heat exchanger is typically arranged to allow the fan to draw return air from the enclosure to be conditioned to the indoor unit and for the same fan to circulate air through the heat exchanger for conditioning the air and then back to the space to be conditioned. The indoor heat exchanger is typically operated under the control of the thermostat located in the space to be conditioned. The thermostat acts to control both the refrigeration circuit and the fan.

The indoor unit designed to be supported by the base pad assembly of the present invention, is designed in a specific configuration to effectively utilize a cylindrical heat exchanger and to provide a compact unit having spaced peripheral duct openings about the circumference such that numerous ducts may be connected to the indoor unit for supplying conditioned air to the appropriate spaces within the enclosure. By utilizing a cylindrical heat exchanger and a polygon cabinet the air is evenly distributed through the entire heat exchanger and is thereafter evenly distributed to the ducts spaced about the cabinet. A cylindrical heat exchanger and a polygon cabinet provides for a reduced physical volume and lower installation costs since the duct outlets may simply be connected to flexible duct to supply air to each space to be conditioned.

Generally, the polygon cabinet of the indoor fan coil is located in an attic in order that the air discharged from the duct openings be connected by way of ducts to each space to be conditioned. However, the bottom of the cabinet is generally concave in order that the condensate may drain through the bottom of the unit to a disposal area. Moreover, the concave shape of the bottom portion of the fan cabinet requires a special jig to prevent the cabinet from moving from side to side while being assembled. Further, after assembly, the unit is generally packed and shipped with packing material supporting it during transportation. The packing material is then removed prior to installation of the unit in the attic. Also, a support pad must be secured to the attic joists for supporting the indoor fan coil during operation.

The disclosed base pad assembly provides a means for holding the unit during factory assembly, securing the unit during shipping, supporting the unit during operation, and providing insulation during operation.

SUMMARY OF THE INVENTION

The present invention is directed to an improved base pad assembly for an indoor fan coil and a method of assembling said base pad assembly.

In a preferred embodiment, the polygon base pad assembly consists of a polystyrene inner support portion and a polypropylene outer cover portion. The outer cover, which is open at the top, contains flexible flange means around the perimeter of the top to secure the inner support portion within the outer cover.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
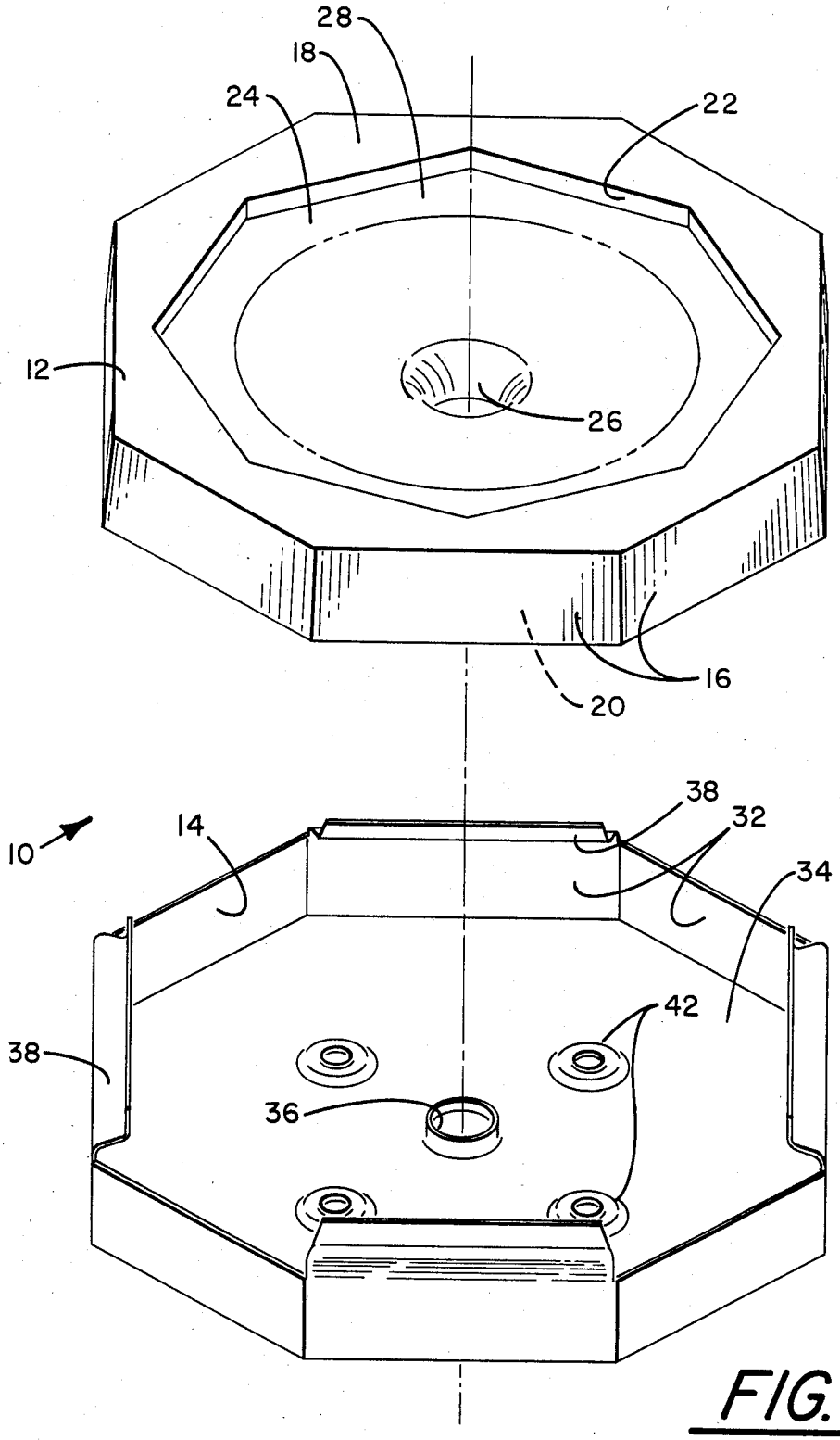
FIG. 1 is an exploded perspective view of the base pad assembly of the present invention.
Figure 2:
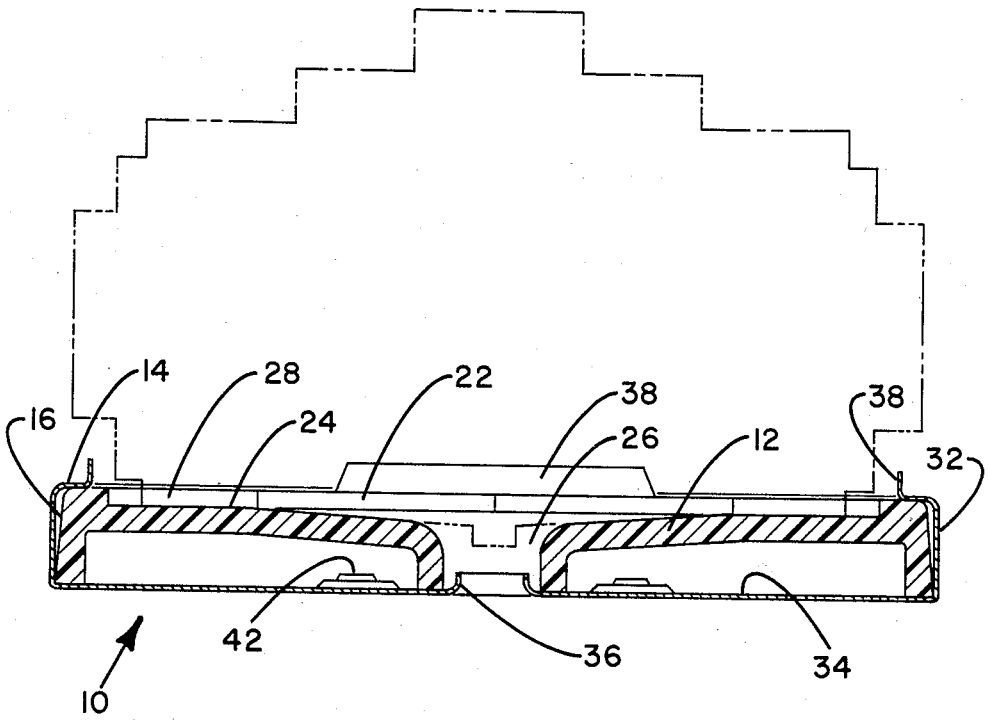
FIG. 2 is a vertical section taken along the center line of the base pad assembly of the present invention.

Referring to FIG. 1, there is illustrated a base pad assembly 10 for use with an indoor fan coil unit of a split type air conditioning system. Although normally mounted in an attic, the fan coil unit and base pad assembly may be mounted anywhere within the structure to be conditioned.

Typically, an outdoor unit (not shown) is mounted on a pad or some other mounting structure exterior to the structure and in communication with outdoor ambient air. In a straight cooling unit the outdoor unit would include both a condenser and a compressor. If the outdoor unit is a portion of a heat pump the outdoor unit would additionally include a four-way valve and the condenser would be the outdoor heat exchanger capable of being either the condenser or the evaporator depending on the mode of operation of the system.

Located within the indoor fan coil unit, which is inside the structure to be conditioned, is a heat exchanger formed from a plurality of runs of heat exchange tubing wound in a generally cylindrical configuration. Refrigerant lines connect the indoor fan coil to the outdoor unit.

As can be seen in FIG. 1, the base pad assembly 10 according to the invention is divided into an inner support portion 12 and an outer cover portion 14. The inner support portion 12 has a polygon outer wall 16, a top surface 18, a bottom surface 20, an inner wall 22, which in conjunction with inner surface 24 defines a recess 28 for supporting part of the cabinet of the indoor fan coil unit, and an aperture extending through the bottom of said base pad assembly for draining condensate therefrom. The recess 28 is shown generally as an octagon. However, it is to be understood that the recess 28 may have any number of sides, e.g. three, six, nine, etc., depending upon the number of sides (i.e. the number of outlets) of the indoor fan coil unit.

The outer cover portion 14 includes walls 32 of similar shape to the outer wall 16, a base 34 connected to the walls 32 and forming a cup-shaped or open topped outer cover portion. The outer cover portion 14 also includes an aperture 36 concentric with aperture 26 of the inner support portion 12. Flexible flanges 38 connected to portions of some of walls 32 and extending inwardly therefrom, frictionally engage the top surface 18 of the inner support portion 12 to form the base pad assembly 10.

The outer cover portion 16 may also include a plurality of secondary drains 42 for providing a backup drain opening should the primary drain aperture 36 fail to function. The secondary drains 42 generally contain knock-out plugs which allow an installer to choose the most convenient position for the secondary drain to insure that condensate dripping from the heat exchanger of the indoor fan coil unit is directed to a proper disposal area.

Usually the indoor fan coil unit cabinet has a concave bottom in order that condensate drains from the coils by way of gravity to a collection point. Accordingly, during assembly of the indoor fan coil unit a support base must be used to prevent the unit from shifting on its bottom. Further, after assembly, the indoor fan coil unit again must be placed on a base in order that the unit may be packed for shipment. Generally, however, the packing material is discarded when the unit has reached its destination and is ready for installation in the space to be conditioned. Finally, during installation of the unit in the space to be conditioned, generally in an attic having longitudinally spaced joists, the unit must be mounted on a pad. The use of the base pad assembly of the present invention permits the indoor fan coil unit to be assembled, shipped, and installed using the same base pad assembly.

It has been found that using polystyrene for the inner support portion 12 and polypropylene for the outer cover portion 14 gives satisfactory performance during use and provides insulation and vibration isolation from the surroundings.

What is claimed is:

1. A base pad assembly for supporting, during assembly, shipping, installation and operation, a fan coil unit of the type having a generally cylindrical heat exchanger enclosed in a polygon shaped cabinet, comprising:

a first member including a base portion, a top portion, side walls connecting said base portion with said top portion, a top surface recessed into said top portion and dimensionally generally coextensive in area with the area of the bottom of the polygon shaped cabinet, and an aperture axially extending therethrough for draining liquid from said top surface; and a second member including a bottom portion, a side portion extending generally perpendicular from said bottom portion and defining a partial cover for said first member, and a plurality of integral projection means attached to and extending inwardly from said side portion for releasably securing said first member within said second member, wherein said second member bottom portion includes an aperture which is so located as to be in registration with said first member aperture.

2. A base pad assembly as recited in claim 1 wherein said first member is composed of polystyrene and said second member is composed of polyproplene.

3. A base pad assembly as set forth in claim 1 wherein said second member bottom portion includes a plurality of knockout portions which may be selectively removed to provide an aperture for the drainage of liquid from said bottom portion.

4. The base pad as set forth in claim 1 wherein said top recessed surface includes a lower surface which slopes radially inward to said aperture for enhancing the drainage thereto.

* * * * *